US009021744B2

(12) United States Patent
Kirkpatrick et al.

(10) Patent No.: US 9,021,744 B2
(45) Date of Patent: May 5, 2015

(54) HEAT RECOVERY STEAM GENERATOR ACCESS DOOR KIT

(76) Inventors: Michael Wayne Kirkpatrick, Buckeye, AZ (US); Phillip Nolan Hamilton, Buckeye, AZ (US)

( * ) Notice: Subject to any disclaimer, the term of this patent is extended or adjusted under 35 U.S.C. 154(b) by 0 days.

(21) Appl. No.: 13/573,059

(22) Filed: Aug. 17, 2012

(65) Prior Publication Data

US 2014/0047774 A1 Feb. 20, 2014

(51) Int. Cl.
*F22B 37/02* (2006.01)

(52) U.S. Cl.
CPC ..... *F22B 37/02* (2013.01)

(58) Field of Classification Search
USPC ..... 49/57, 463, 464, 465, 501, 504; 292/251, 256, 256.5, 256.71, 256.73, 292/256.75; 220/328, 327, 324, 315; 16/412–414
See application file for complete search history.

(56) References Cited

U.S. PATENT DOCUMENTS

| | | | | | |
|---|---|---|---|---|---|
| 976,974 | A | * | 11/1910 | Young | 114/203 |
| 1,331,005 | A | | 2/1920 | Duncan | |
| 1,665,369 | A | * | 4/1928 | Joy et al. | 220/324 |
| 1,990,189 | A | * | 2/1935 | King | 220/327 |
| 2,113,776 | A | * | 4/1938 | Smith | 220/327 |
| 2,343,833 | A | * | 3/1944 | Abraham | 52/223.7 |
| 2,584,404 | A | * | 2/1952 | Webb | 110/173 R |
| 2,670,232 | A | * | 2/1954 | Schmitz | 292/256.73 |
| 2,752,187 | A | * | 6/1956 | Gordon | 292/256.75 |
| 3,666,134 | A | * | 5/1972 | Rauch | 220/324 |
| 3,672,715 | A | * | 6/1972 | Carson | 292/257 |
| 3,756,640 | A | * | 9/1973 | Johnson | 292/256.75 |
| 3,786,955 | A | * | 1/1974 | Mowatt-Larssen | 220/327 |
| 3,907,157 | A | * | 9/1975 | Beattie | 220/327 |
| 4,097,716 | A | * | 6/1978 | Reichelt et al. | 219/137 R |
| 4,157,146 | A | * | 6/1979 | Svenson | 220/324 |
| 4,193,173 | A | * | 3/1980 | Lorenz | 220/327 |
| 4,207,706 | A | * | 6/1980 | Haines | 49/141 |
| 4,574,973 | A | * | 3/1986 | Lewis et al. | 49/65 |
| 4,685,586 | A | * | 8/1987 | Lewis et al. | 220/305 |
| 4,809,873 | A | | 3/1989 | Fossey | |
| 5,158,043 | A | * | 10/1992 | Emsbo | 122/498 |
| 5,159,175 | A | * | 10/1992 | Loeber | 219/137 R |
| 5,190,207 | A | * | 3/1993 | Peck et al. | 228/170 |
| 5,338,577 | A | * | 8/1994 | Burdette, II | 427/453 |
| 5,732,844 | A | * | 3/1998 | Zorzini | 220/325 |
| 5,803,021 | A | * | 9/1998 | Rourke et al. | 122/498 |
| 5,878,940 | A | * | 3/1999 | Rosenbalm | 228/135 |
| 6,135,666 | A | * | 10/2000 | Kelly et al. | 403/256 |
| 6,167,656 | B1 | * | 1/2001 | Devlin et al. | 49/463 |
| 6,241,144 | B1 | * | 6/2001 | Mandon | 228/135 |
| 6,261,643 | B1 | * | 7/2001 | Hasz et al. | 427/419.1 |
| 6,412,221 | B1 | * | 7/2002 | Emsbo | 49/154 |
| 6,723,950 | B1 | * | 4/2004 | Lund | 219/121.64 |
| 7,044,677 | B2 | * | 5/2006 | Moser et al. | 403/252 |
| 7,175,313 | B2 | * | 2/2007 | Bednara et al. | 362/265 |
| 7,389,610 | B1 | * | 6/2008 | McMakin et al. | 49/254 |
| 7,849,644 | B2 | * | 12/2010 | Melesky | 52/202 |
| 8,136,851 | B2 | * | 3/2012 | Nelson | 292/198 |
| 8,225,721 | B2 | * | 7/2012 | Hunter | 105/377.07 |
| 2005/0205576 | A1 | * | 9/2005 | Bednara et al. | 220/328 |

* cited by examiner

*Primary Examiner* — Katherine Mitchell
*Assistant Examiner* — Justin Rephann
(74) *Attorney, Agent, or Firm* — Michael W. Goltry; Robert A. Parsons; Parsons & Goltry

(57) ABSTRACT

A heat recovery steam generator access door kit comprising a door assembly comprising an insulation box; a door face attached to the insulation box that is larger in width and length than the insulation box and projects around the perimeter of the insulation box; at least one cross beam; a frame assembly comprising a frame and at least one swing bolt assembly attached to the frame.

7 Claims, 6 Drawing Sheets

Fig. 5
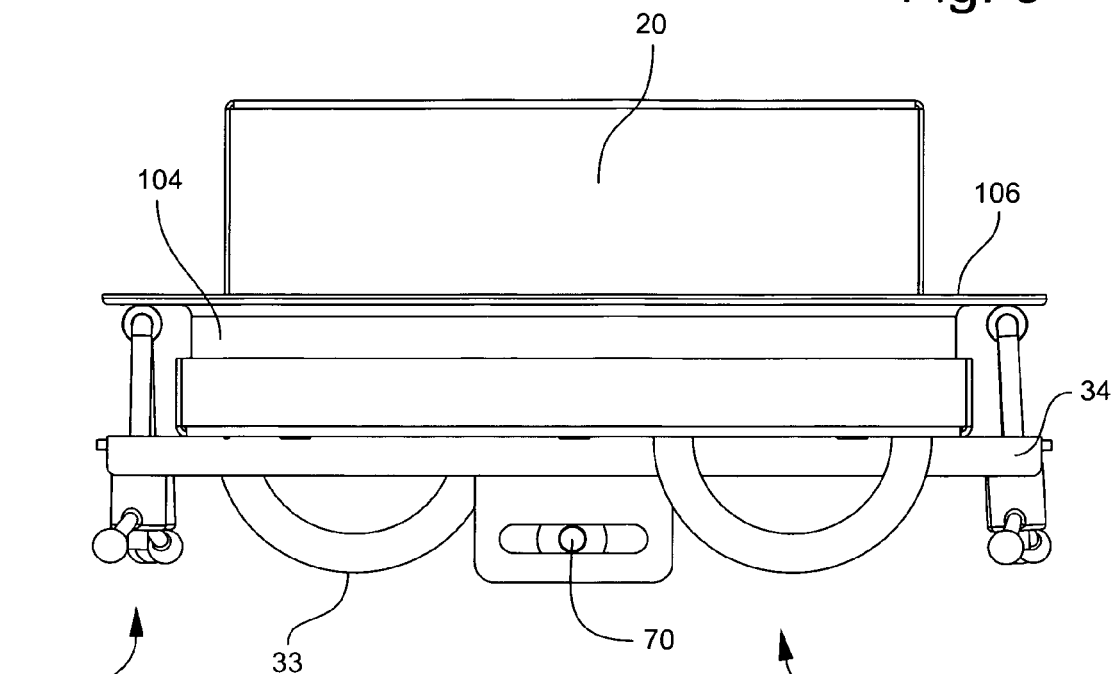
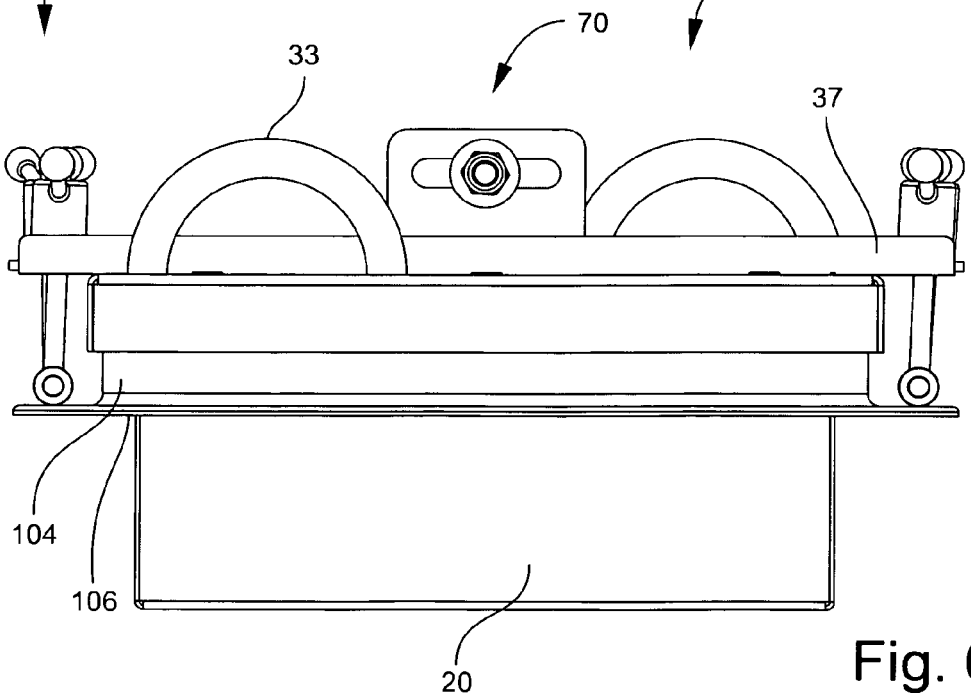
Fig. 6

HEAT RECOVERY STEAM GENERATOR ACCESS DOOR KIT

FIELD OF THE INVENTION

The present invention relates to the field of heat recovery steam generator access doors.

BACKGROUND

Heat recovery Steam Generator (HRSG) doors are a necessary, but unpleasant feature of many industries, such as power generation. Typically, a HRSG access door is a large square door having a flange that runs the perimeter of the body of the door. This flange is bolted to a mating flange located on an insulation box mounted over the HRSG access port using a bolt and nut attachment mechanism that is threaded through a number of apertures located in both flanges. This configuration presents a number of problems.

First, there is typically a thermal sealing gasket that is placed between the two flanges when mounting the door. Since both flanges are flat, there is no way to accurately place, and replace, the thermal sealing gasket. Therefore technicians commonly resort to self-help solutions, such as the use of duct tape to "tape" the thermal sealing gasket to a flange. Further, since the thermal sealing flange is placed between the two flanges, and the HRSG access door is bolted to the HRSG access using a series of bolts, then the thermal sealing gasket needs to be perforated to match the bolt holes, thereby compromising both the thermal properties and sealing capabilities.

It has been noted that a common problem caused by heat cycling due to compromised thermal insulation due to perforations in the thermal sealing gasket is that weld points attaching the insulation box to the HRSG.

Thus there is a current and continuing need for an improved HRSG access door that reduces or eliminates many of the above discussed problems.

SUMMARY OF THE INVENTION

It is an object of the present invention to provide an HRSG access door kit comprising a door assembly comprising an insulation box; a door face attached to the insulation box that is larger in width and length than the insulation box and projects around the perimeter of the insulation box; at least one cross beam; a frame assembly comprising a frame; and at least one swing bolt assembly.

It is another object of the present invention to provide the HRSG access door kit described above wherein the door face further includes an inwardly directed lip that runs the perimeter of the door face and creates a channel between the insulation box, the door face and the door face lip.

It is another object of the present invention to provide the HRSG access door kit described above further comprising two handles, each located at opposite diagonal corners of an outside surface of the door face.

It is another object of the present invention to provide the HRSG access door kit described above further comprising an adjustable tie-rod that is adjustably secured to the at least one cross beam in a substantially vertical orientation.

It is another object of the present invention to provide the HRSG access door kit described above further comprising a thermal barrier coating that coats the entire door assembly.

It is another object of the present invention to provide the HRSG access door kit described above wherein insulation box includes at least one tab, the door face includes a complementary slot such that the tab inserts into the slot and welds that attach the door face to the insulation box are located at the junction of the tab and slot on an outside surface of the door face.

It is another object of the present invention to provide the HRSG access door kit described above wherein the swing bolt assembly comprises at least L or T shaped bolt, where at least one short leg of the L or T shape is inserted into at least one lumen securely attached to the door frame; and a nut that threadably attaches to the L or T shaped bolt.

It is another object of the present invention to provide the HRSG access door kit described above wherein the L or T shaped bolt is pivotally inserted into the at least one lumen.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

BRIEF DESCRIPTION OF THE DRAWINGS

FIG. 5 is a top view of the door kit according to the present invention;

FIG. 6 is a bottom view of the door kit according to the present invention;

DESCRIPTION OF PREFERRED EMBODIMENTS

Figure 1:
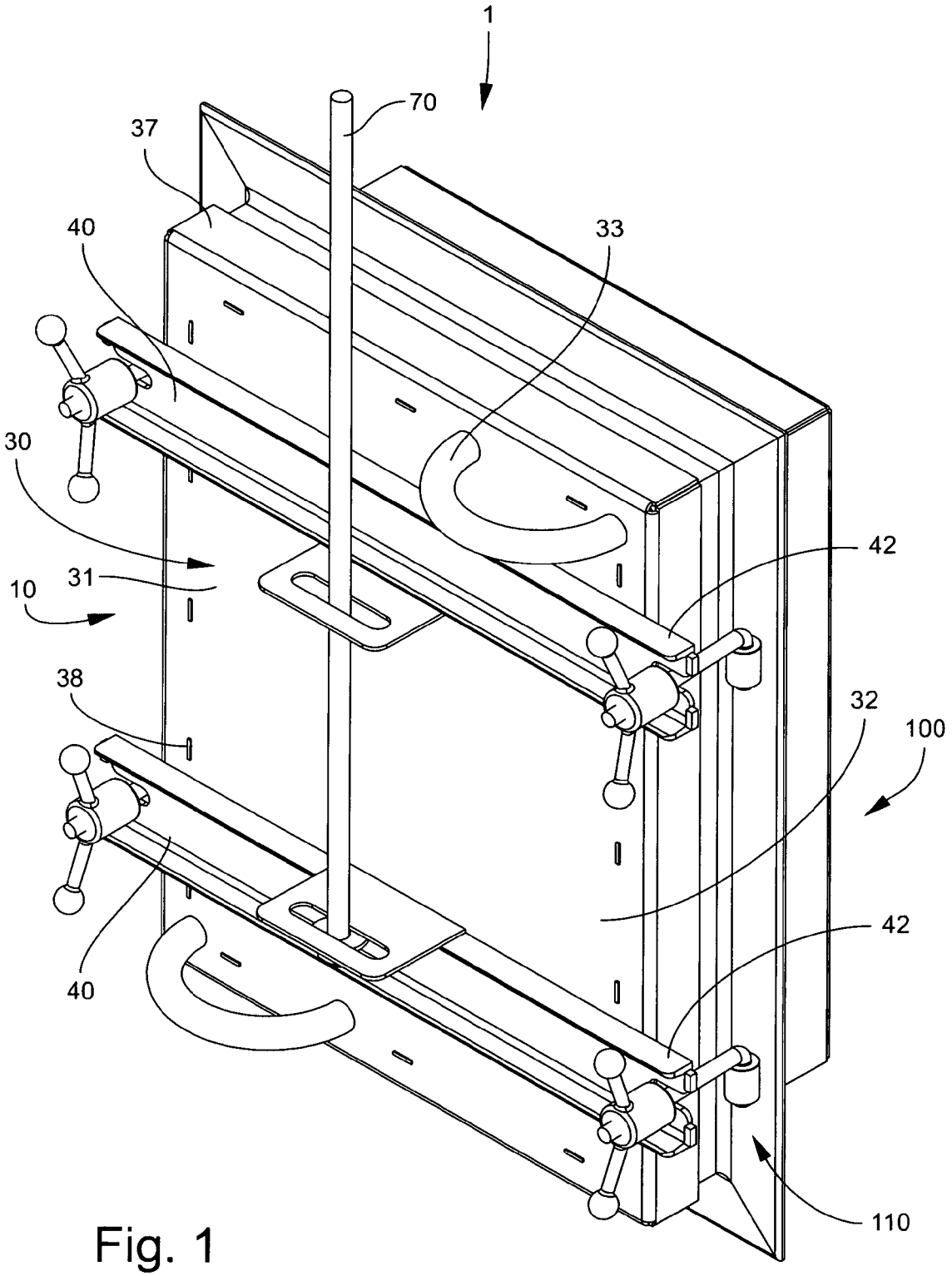
FIG. 1 is a perspective view of the door kit according to the present invention.
Figure 2:
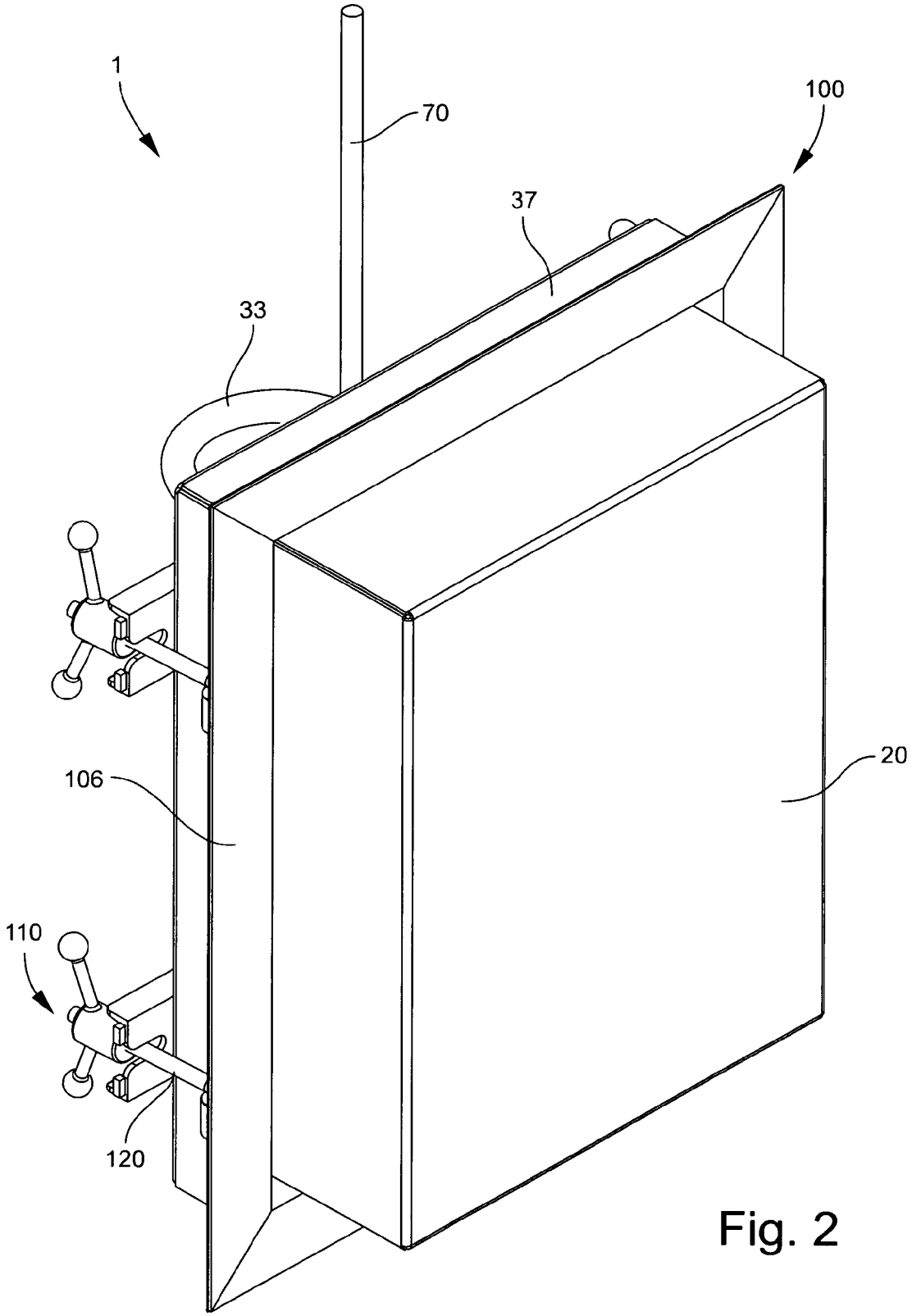
FIG. 2 is a reverse perspective view of the door kit according to the present invention.
Figure 3:
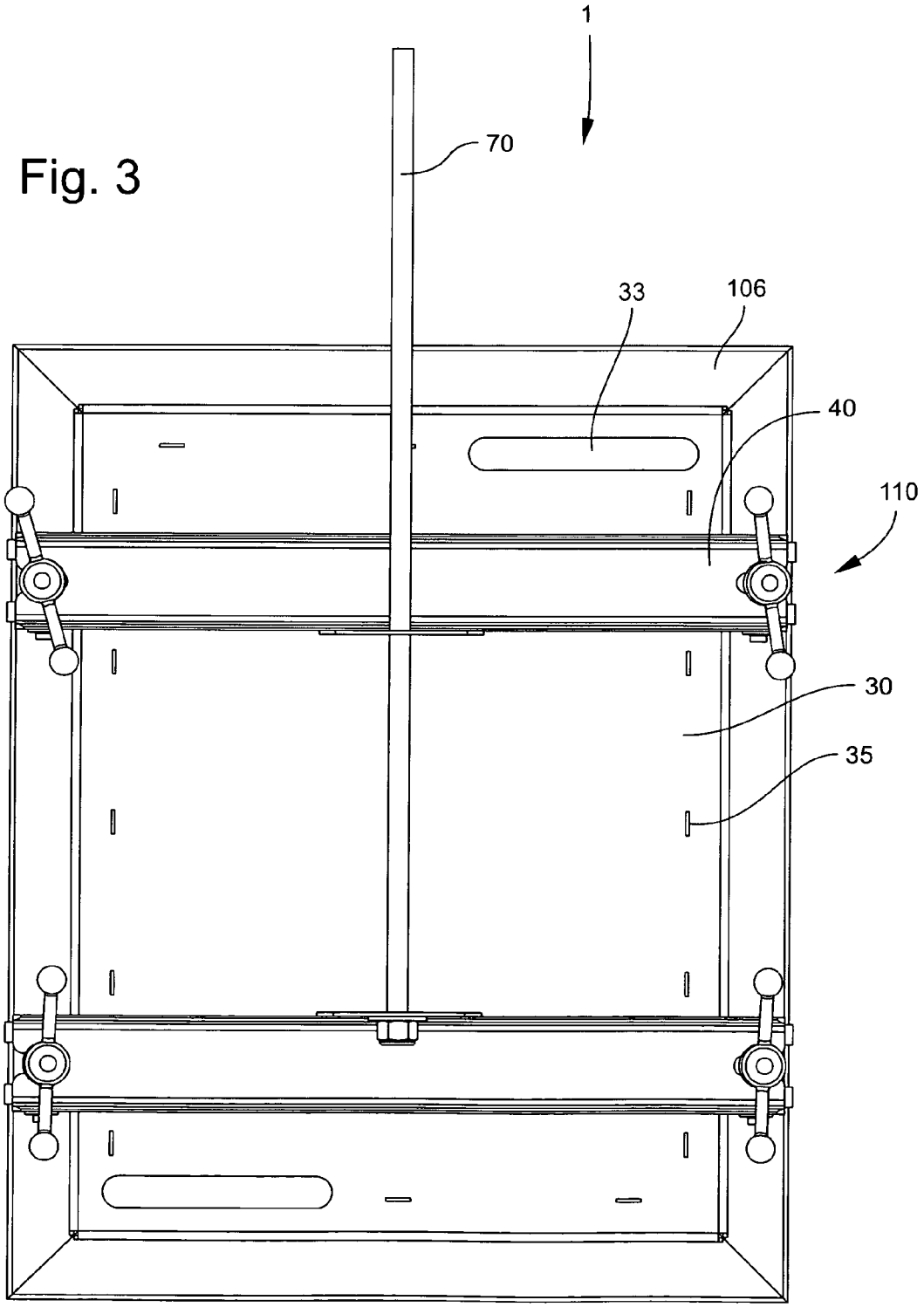
FIG. 3 is front view of the door kit according to the present invention.
Figure 4:
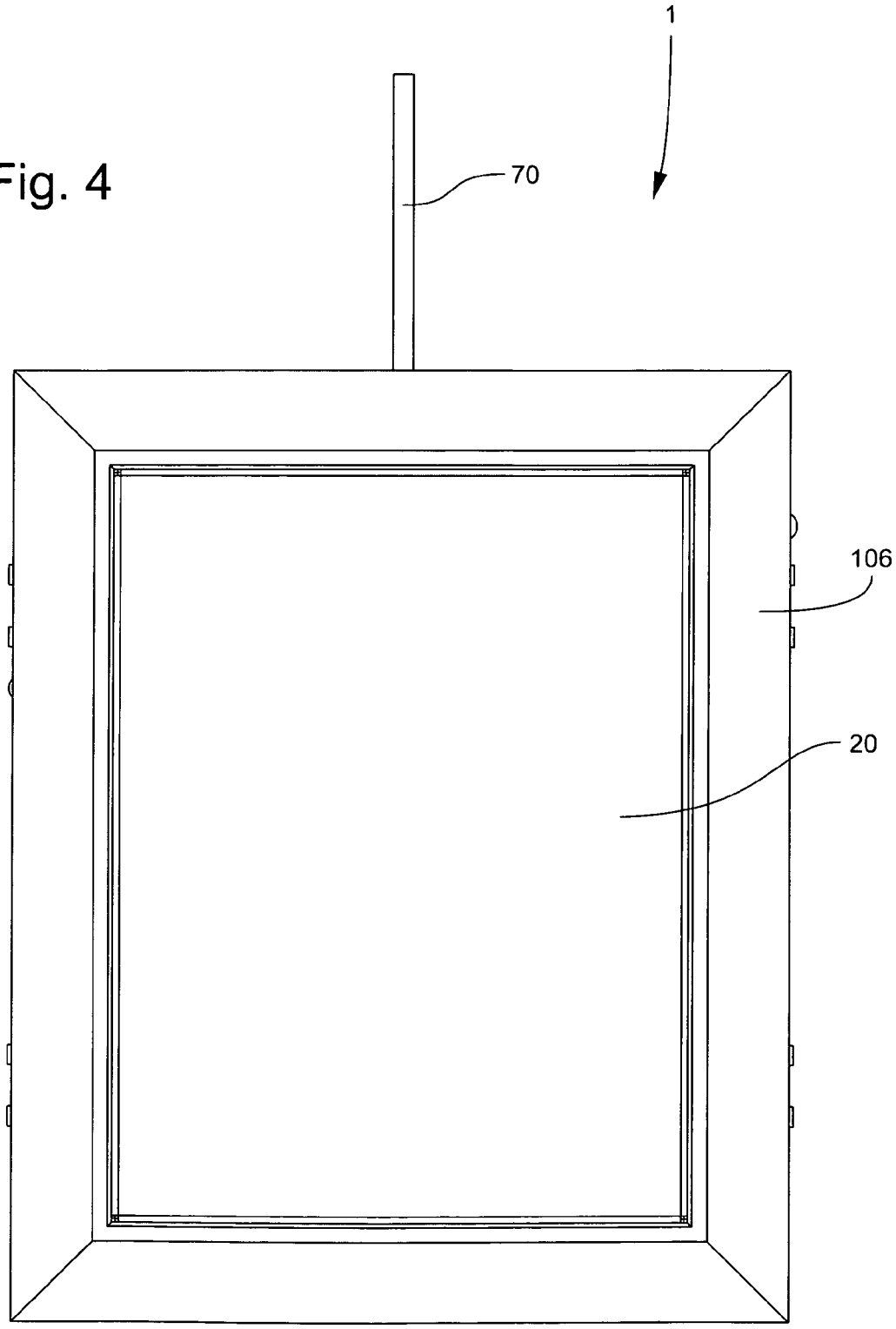
FIG. 4 is a rear view of the door kit according to the present invention.
Figure 7:
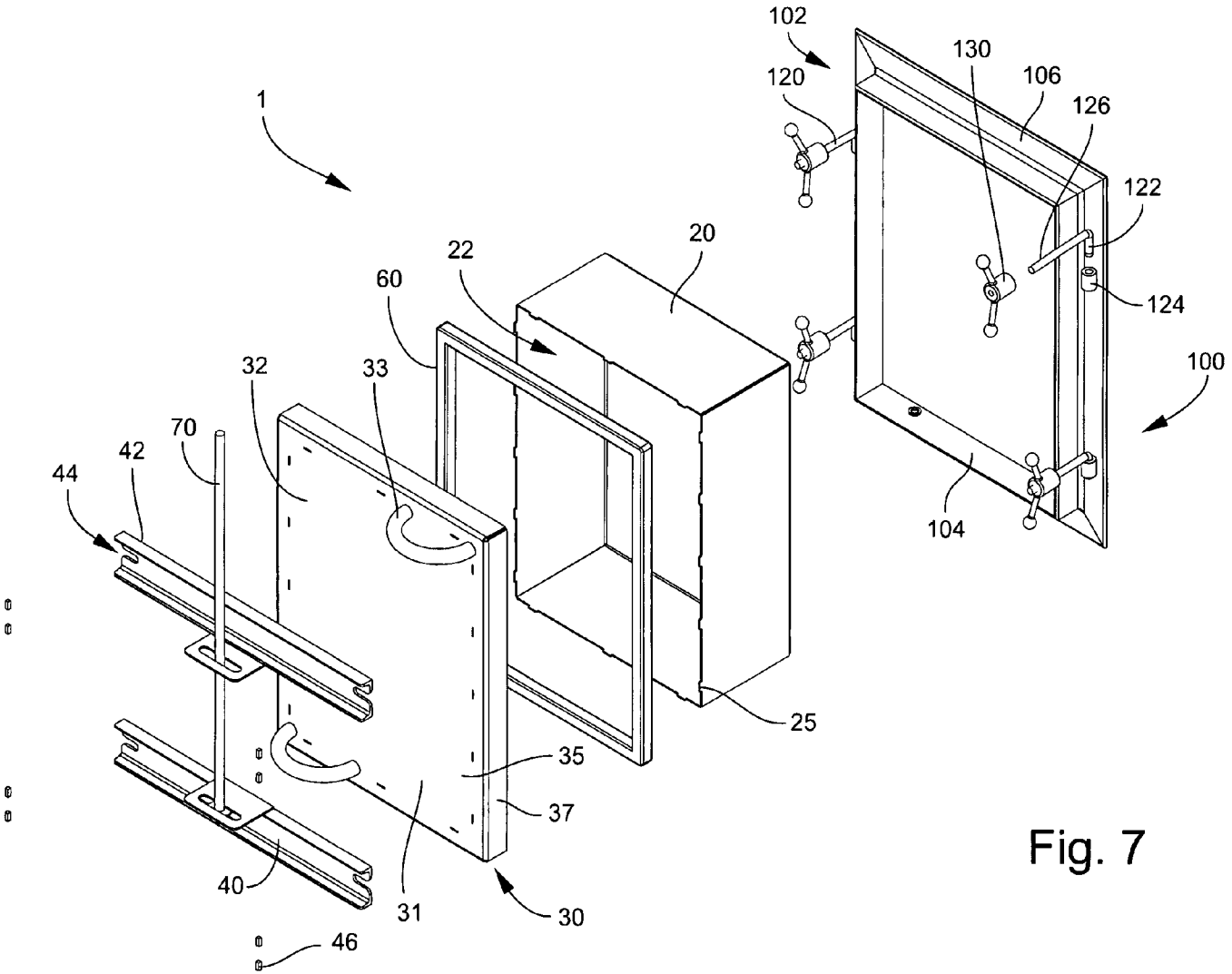
FIG. 7 an exploded view of the door kit according to the present invention.

The present invention is useful for sealing HRSG access ports.

With reference to the figures, the present invention is a HRSG access door kit 1 that comprises a door assembly 10 and a frame assembly 100.

The door assembly 10 comprises an insulation box 20, a door face 30 attached to the insulation box 20 where the door face 30 is larger in width and length than the insulation box 20 and projects around the perimeter of the insulation box 20. There is also at least one, preferably two, more preferably three, cross beam 40 attached to a front surface 32 of the door face 30.

The cross beams 40, preferably channel beams, which are attached to the front surface 32 of the door face 30, are preferably attached in a parallel orientation. However, non-parallel attachment orientations are also considered to fall with the scope of the present invention. Each cross beam 40 is lightly longer than the width or height of the door face 30. This allows a portion of each end 42 of the cross beam 40 to project beyond the door face 30. Each end 42 of each cross beam 40 includes at least one bolt receiving groove 44. The bolt receiving grooves 44 include a safety feature, which are offset key tabs 46 elongating the L-Bolt groove 44 to prevent any unintentional impact from allowing the door 10 from swinging open during use. Hence wing nut bolts, discussed below, have to be loosened completely to allow the L-bolts, discussed below, to swing open from a locked position.

In a preferred embodiment, the door face 30 is a planar piece 31 having a series of slots 35 set back from the perimeter of the door face 30. These slots 35 are the same shape as the insulation box 20.

In a preferred embodiment, the insulation box 20 is a five-sided open cuboid defining an interior volume 22. This interior volume 22 is preferably filled with an insulating material (not illustrated), such as a high temperature insulation wool. Preferably, the insulation box 20 includes at least one, preferably four, more preferably eight tabs 25 located on the perimeter of the open face of the five-sided open cuboid.

The series of slots 35 included in the door face 35 are arranged such that the tabs 25 located on the insulation box 20 are received by the slots 35. The tabs 25 are then welded to the front surface 32 of the door face 30, thereby securing the insulation box 20 to the door face 30.

In a preferred embodiment the door face 30 further includes an inwardly directed lip 37 that runs the perimeter of the door face 30 and creates a channel, not shown, defined by the insulation box 20, the door face 30 and the door face lip 37. Located inside of the channel is a thermally insulating gasket 60. In a preferred embodiment, this thermally insulating gasket 60 substantially fills the channel and includes no perforations.

In a preferred embodiment the door face 30 also includes preferably two, handles 33, each located at opposite diagonal corners of the front surface 32 of the door face 30. These door handles 33 are ergonomically positioned on the door face 30 perimeter for easy maneuverability.

In a preferred embodiment the door face 30 may further comprising an adjustable tie-rod 70 that is adjustably secured to the at least one cross beam 40 in a substantially vertical orientation. This adjustable tie-rod 70 is a universal suspension bracket. Thus, the HRSG door assembly 10 according to the present invention may be mated with many types of door suspension; i.e. Jib, Trolley, Swing Frame and the like.

The kit 10 according to the present invention includes a frame assembly 100. The frame assembly b100 comprises at least a frame 102 sized to receive the insulation box 20 and at least one swing bolt assembly 110. In one embodiment the frame assembly 102 comprises four side pieces 104 that define an opening. The four side pieces 104 may be welded or formed directly around the perimeter of the HRSG portal.

In another embodiment the frame assembly 100 comprises the four side pieces 104 that define an opening and further comprises a base flange 106 that extends around the perimeter of the four sides 104 thereby providing a surface to secure the frame assembly 100 to the HRSG.

The frame assembly 100 further includes at least one swing bolt assembly 110 comprising at least one L or T shaped bolt 120, where at least one short leg 122 of the L or T shape is inserted into at least one lumen 124 securely attached to the door frame assembly 100; and a nut 130 that threadably attaches to the a terminal end 126 of the L or T shaped bolt 120. The L or T shaped bolts 120 are easily removably inserted into the at least one lumen 124 such that they are quick change fasteners. The L or T shaped bolts 120 can be removed and replaced in less than 60 seconds per bolt 120.

Using the swing bolt assembly 120 provides tool less ingress/egress. This means that wrenches, sockets, air impact tools and the like are unnecessary; wing nut style nuts 130 may be tightened or loosened completely by hand. Further, use of the swing bolt assemblies 120 provides visual closure verification. One can visually verify that the door assembly 10 is closed by the positioning of the L or T bolts making verification much easier than existing door models.

The frame assembly 100 is preferably pre-fabricated and designed for quick and easy installation. Simply remove existing port access flange face and place the new pre-fabricated frame assembly 100 over the remaining remnant of the previous flange face then align, clamp, and securely fasten.

Preferably, the HRSG access door kit 1 is coated with a thermal barrier (not shown) that coats the entire door assembly. This thermal barrier is a thermal ceramic coating for corrosion resistance and thermal performance. Further, this coating allows door to be painted if desired in order to match preexisting colors.

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A heat recovery steam generator (HRSG) access door kit comprising a door assembly comprising an insulation box, the insulation box includes an interior volume for being filled with an insulating material, a perimeter defining an open face to the interior volume, and tabs on the perimeter;

ii. a door face, the door face includes an outside surface, an inside surface, and slots that extend through the door face from the outside surface to the inside surface, the inside surface of the door face is applied to the perimeter of the insulation box, the door face is larger in width and length than the insulation box and projects around the perimeter of the insulation box, each of the tabs of the insulation box is inserted into one of the slots, a weld on the outside surface of the door face at the junction of each one of the tabs and a corresponding one of the slots attaches the door face to the insulation box;

iii. at least one cross beam;

b) a frame assembly comprising i. a frame; and ii. at least one swing bolt assembly.

2. The HRSG access door kit according to claim 1 wherein the door face further includes an inwardly directed lip that runs the perimeter of the door face.

3. The HRSG access door kit according to claim 1 further comprising two handles, each located at opposite diagonal corners of the outside surface of the door face.

4. The HRSG access door kit according to claim 1 further comprising an adjustable tie-rod that is adjustably secured to the at least one cross beam in a substantially vertical orientation.

5. The HRSG access door kit according to claim 1 further comprising a thermal barrier coating that coats the entire door assembly.

6. The HRSG access door kit according to claim 1 wherein the swing bolt assembly comprises a) at least L or T shaped bolt, where at least one short leg of the L or T shape is inserted into at least one lumen securely attached to the door frame; and b) a nut that threadably attaches to the L or T shaped bolt.

7. The HRSG access door kit according to claim 6 wherein the L or T shaped bolt is pivotally inserted into the at least one lumen.

* * * * *